US005931059A

United States Patent [19]

Hammer

[11] Patent Number: 5,931,059

[45] Date of Patent: Aug. 3, 1999

[54] BUCKET LID REMOVING TOOL

[76] Inventor: Charles E. Hammer, 4943 SW. 20th St., Fort Lauderdale, Fla. 33317

[21] Appl. No.: 09/037,809

[22] Filed: Mar. 10, 1998

[51] Int. Cl.[6] ..... B67B 7/16

[52] U.S. Cl. ..... 81/3.57; 81/3.55; 81/3.56

[58] Field of Search ..... 81/3.55, 3.56, 81/3.57

[56] References Cited

U.S. PATENT DOCUMENTS

D. 244,575 6/1977 Endres et al. ..... D8/40

1,724,722 2/1929 Plack ..... 81/3.56

*Primary Examiner*—David A. Scherbel

*Assistant Examiner*—Sinclair Skinner

[57] ABSTRACT

A bucket lid remover is provided including a strip having an inboard extent with a U-shaped configuration. An outboard extent has a generally J-shaped configuration with a vertically oriented upper portion and an angled lower portion coupled to a bottom end of the upper portion and extending upwardly and inwardly therefrom. A horizontally oriented intermediate extent is coupled between the inboard extent and the outboard extent. Also included is a screw driver removably mounted to the strip and extending therefrom for leverage purposes.

7 Claims, 2 Drawing Sheets

BUCKET LID REMOVING TOOL

BACKGROUND OF THE INVENTION

1. Field of the Invention

The present invention relates to lid removers and more particularly pertains to a new bucket lid removing tool for removing lids from buckets.

2. Description of the Prior Art

The use of lid removers is known in the prior art. More specifically, lid removers heretofore devised and utilized are known to consist basically of familiar, expected and obvious structural configurations, notwithstanding the myriad of designs encompassed by the crowded prior art which have been developed for the fulfillment of countless objectives and requirements.

Known prior art lid removers include U.S. Pat. No. 5,069,090; U.S. Pat. No. 4,967,436; U.S. Pat. No. 4,234,988; U.S. Pat. No. 4,586,404; U.S. Pat. No. 4,216,685; and U.S. Pat. No. Des. 276,585.

In these respects, the bucket lid removing tool according to the present invention substantially departs from the conventional concepts and designs of the prior art, and in so doing provides an apparatus primarily developed for the purpose of removing lids from buckets.

SUMMARY OF THE INVENTION

In view of the foregoing disadvantages inherent in the known types of lid removers now present in the prior art, the present invention provides a new bucket lid removing tool construction wherein the same can be utilized for removing lids from buckets.

The general purpose of the present invention, which will be described subsequently in greater detail, is to provide a new bucket lid removing tool apparatus and method which has many of the advantages of the lid removers mentioned heretofore and many novel features that result in a new bucket lid removing tool which is not anticipated, rendered obvious, suggested, or even implied by any of the prior art lid removers, either alone or in any combination thereof.

To attain this, the present invention generally comprises a rigid strip having a constant thin thickness and width along an entire length thereof. As shown in FIGS. 1 & 2, the strip includes an inboard extent with a U-shaped configuration. A first circular bore is formed about a horizontal axis in a side face of the inboard extent. Associated therewith is an outboard extent having a generally J-shaped configuration. The outboard extent is equipped with a vertically oriented upper portion having a second circular bore formed therein about a horizontal axis. It should be noted that the first and second circular bores are each formed at a common elevation. Coupled to a bottom end of the upper portion and extending upwardly and inwardly therefrom is an angled lower portion. The angled lower portion has a planar rectangular configuration and further is angled about 45 degrees with respect to the horizontal. A horizontally oriented intermediate extent is coupled between the inboard extent and the outboard extent. The intermediate extent has a threaded aperture formed about a vertical axis in a central portion thereof. Also included is a wing bolt threadedly coupled within the threaded aperture of the intermediate extent of the strip. The wing bolt is adapted for being vertically adjusted within the threaded aperture. Finally, a screwdriver has a first end adapted to be removably inserted within the first and second circular bores of the strip. As such, the first end abuts a side face of the inboard extent of the strip, as shown in FIG. 2. Further, the wing nut may be adjusted to abut an intermediate portion of the screwdriver for fixing the same with respect to the strip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bucket lid removing tool apparatus and method which has many of the advantages of the lid removers mentioned heretofore and many novel features that result in a new bucket lid removing tool which is not anticipated, rendered obvious, suggested, or even implied by any of the prior art lid removers, either alone or in any combination thereof.

It is another object of the present invention to provide a new bucket lid removing tool which may be easily and efficiently manufactured and marketed.

It is a further object of the present invention to provide a new bucket lid removing tool which is of a durable and reliable construction.

An even further object of the present invention is to provide a new bucket lid removing tool which is susceptible of a low cost of manufacture with regard to both materials and labor, and which accordingly is then susceptible of low prices of sale to the consuming public, thereby making such bucket lid removing tool economically available to the buying public.

Still yet another object of the present invention is to provide a new bucket lid removing tool which provides in the apparatuses and methods of the prior art some of the advantages thereof, while simultaneously overcoming some of the disadvantages normally associated therewith.

Still another object of the present invention is to provide a new bucket lid removing tool for removing lids from buckets.

Even still another object of the present invention is to provide a new bucket lid removing tool that includes a strip having an inboard extent with a U-shaped configuration. An outboard extent has a generally J-shaped configuration with a vertically oriented upper portion and an angled lower portion coupled to a bottom end of the upper portion and extending upwardly and inwardly therefrom. A horizontally oriented intermediate extent is coupled between the inboard extent and the outboard extent. Also included is a screw driver removably mounted to the strip and extending therefrom for leverage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
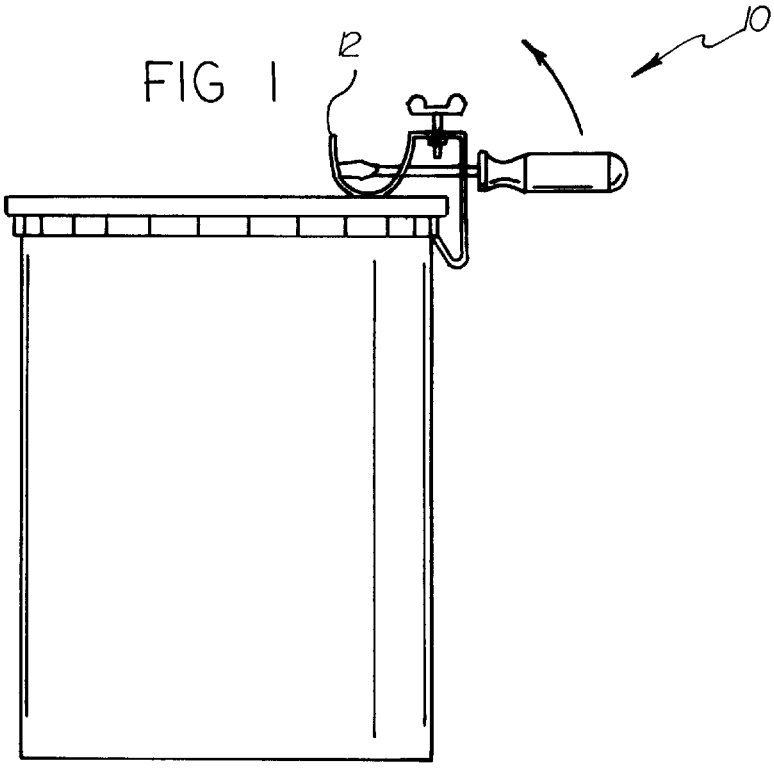
FIG. 1 is a side view of a new bucket lid removing tool according to the present invention.

With reference now to the drawings, and in particular to FIGS. 1 through 4 thereof, a new bucket lid removing tool embodying the principles and concepts of the present invention and generally designated by the reference numeral 10 will be described.

Figure 2:
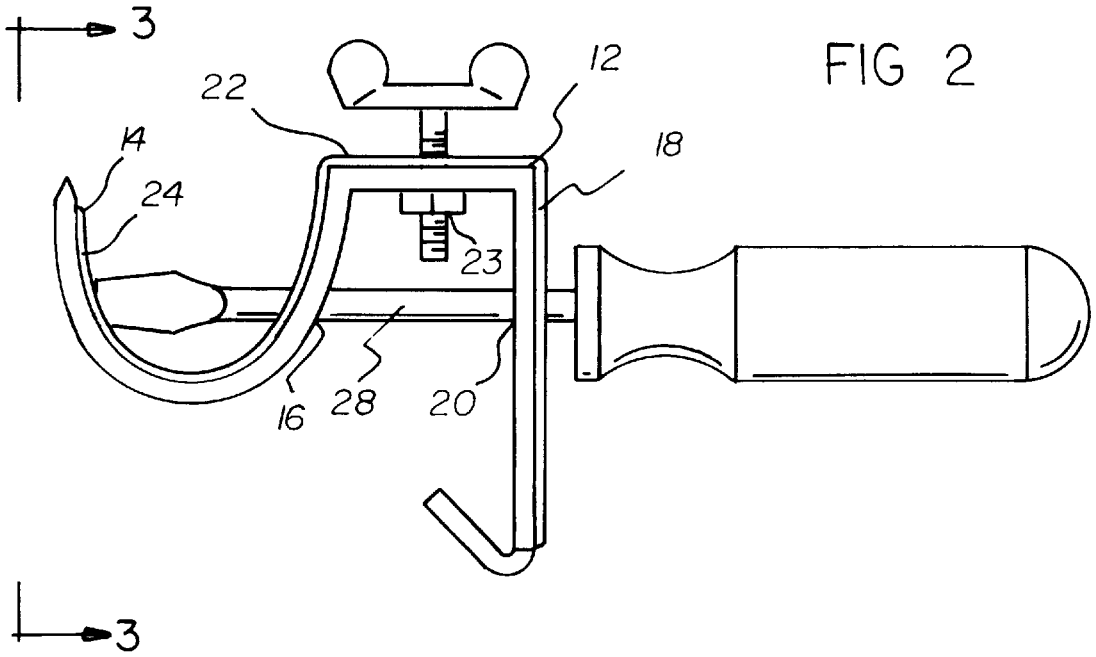
FIG. 2 is a detailed side view of the present invention.
Figure 3:
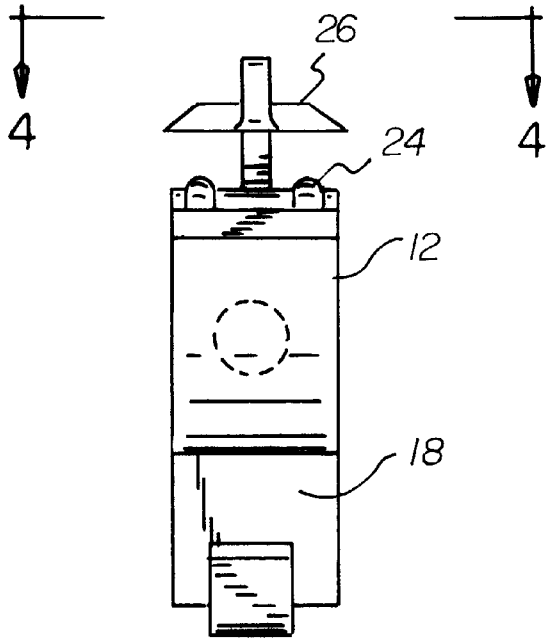
FIG. 3 is a front view of the present invention.

The present invention, designated as numeral 10, includes a rigid strip 12 having a constant thin thickness and width along an entire length thereof. As shown in FIGS. 1 & 2, the strip includes an inboard extent 14 with a U-shaped configuration. A first circular bore 16 is formed about a horizontal axis in a side face of the inboard extent. As shown in FIG. 2, an inboard edge of the inboard extent is tapered with rounded shoulders.

Associated therewith is an outboard extent 18 having a generally J-shaped configuration. The outboard extent is equipped with a vertically oriented upper portion having a second circular bore 20 formed therein about a horizontal axis. It should be noted that the first and second circular bores are each formed at a common elevation. Coupled to a bottom end of the upper portion and extending upwardly and inwardly therefrom is an angled lower portion. The angled lower portion has a planar rectangular configuration and further is angled about 45 degrees with respect to the horizontal. In the preferred embodiment, the outboard extent has a height which is approximately twice that of the inboard extent.

Figure 4:
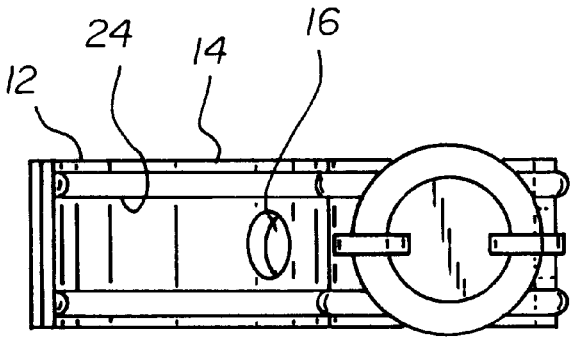
FIG. 4 is a top view of the present invention.

A horizontally oriented intermediate extent 22 is coupled between the inboard extent and the outboard extent. The intermediate extent has a threaded aperture 23 formed about a vertical axis in a central portion thereof. As an option, the threaded aperture may take the form of a threaded nut mounted below an aperture of the intermediate extent. Ideally, a length of the intermediate extent is about ½ a length of the U-shaped inboard extent. As best shown in FIGS. 2 & 4, a pair of parallel strengthening ribs 24 line a top surface of the strip along an entire length thereof. Further, a bead roll may be situated on a bottom surface of the strip for affording further strength.

Also included is a wing bolt 26 threadedly coupled within the threaded aperture of the intermediate extent of the strip. The wing bolt is adapted for being vertically adjusted within the threaded aperture. As shown in FIG. 4, the wing bolt has a generally disk-shaped head with a pair of diametrically opposed gripping ears integrally coupled thereto.

Finally, a screwdriver 28 has a first end adapted to be removably inserted within the first and second circular bores of the strip. As such, the first end of the screwdriver abuts a side face of the inboard extent of the strip, as shown in FIG. 2. Further, the wing nut may be adjusted to abut an intermediate portion of the screwdriver for fixing the same with respect to the strip.

In use, the U-shaped inboard extent of the strip rests on a lid of a bucket while the angled portion of the outboard extent is engaged with a lower surface of a peripheral edge of the lid, as shown in FIG. 1. With the screwdriver secured to the strip, a handle of the screwdriver is urged upwardly for dislodging the lid from the bucket.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bucket lid remover comprising, in combination:

a rigid strip having a constant thin thickness and width along an entire length thereof, the strip including an inboard extent with a U-shaped configuration and a first circular bore formed about a horizontal axis in a side face thereof, an outboard extent having a generally J-shaped configuration with a vertically oriented upper portion having a second circular bore formed therein about a horizontal axis at a common elevation with respect to the first circular bore and an angled lower portion with a planar rectangular configuration coupled to a bottom end of the upper portion and extending upwardly and inwardly about 45 degrees, and a horizontally oriented intermediate extent coupled between the inboard extent and the outboard extent with a threaded aperture formed about a vertical axis in a central portion thereof;

a wing bolt threadedly coupled within the threaded aperture of the intermediate extent of the strip for being vertically adjusted therein; and a screwdriver having a first end adapted to be removably inserted within the first and second circular bores of the strip such that the first end abuts a side face of the inboard extent of the strip and the wing nut may be adjusted to abut an intermediate portion of the screwdriver for fixing the same with respect to the strip.

2. A bucket lid remover comprising:

a strip including an inboard extent with a U-shaped configuration, an outboard extent having a generally J-shaped configuration with a vertically oriented upper portion and an angled lower portion coupled to a bottom end of the upper portion and extending upwardly and inwardly, and a horizontally oriented intermediate extent coupled between the inboard extent and the outboard extent; and leverage means mounted to the strip and extending therefrom for leverage purposes.

3. A bucket lid remover as set forth in claim 2 wherein the strip has a constant thin thickness and width along an entire length thereof.

4. A bucket lid remover as set forth in claim 2 wherein the leverage means is removably mounted to the strip.

5. A bucket lid remover as set forth in claim 2 wherein the leverage means is removably mounted to the strip via a pair of holes formed in the inboard and outboard extents of the strip.

6. A bucket lid remover as set forth in claim 2 wherein the leverage means is removably mounted to the strip via a threaded member.

7. A bucket lid remover as set forth in claim 2 wherein the leverage means includes a conventional screwdriver.

* * * * *